US006986474B2

(12) United States Patent
Bloching et al.

(10) Patent No.: US 6,986,474 B2
(45) Date of Patent: Jan. 17, 2006

(54) CONTROL MODULE FOR AN INJECTOR OF AN ACCUMULATOR INJECTION SYSTEM

(75) Inventors: Wolfgang Bloching, Langenargen (DE); Willibald Schürz, Pielenhofen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/751,036

(22) Filed: Dec. 31, 2003

(65) Prior Publication Data

US 2004/0169094 A1 Sep. 2, 2004

Related U.S. Application Data

(63) Continuation of application No. PCT/DE02/02383, filed on Jul. 1, 2002.

(30) Foreign Application Priority Data

Jul. 2, 2001 (DE) ..... 101 31 953

(51) Int. Cl.
*F02M 59/00* (2006.01)

(52) U.S. Cl. ..... 239/533.2; 239/88; 239/92; 239/124; 123/467

(58) Field of Classification Search ..... 239/533.2, 239/89, 91, 92, 124, 585.1, 88, 533.8; 123/467, 123/469, 446, 458; 251/129.16
See application file for complete search history.

(56) References Cited

U.S. PATENT DOCUMENTS 5,660,368 A * 8/1997 De Matthaeis et al. .. 251/30.02
5,803,361 A 9/1998 Horiuchi et al.
5,873,526 A 2/1999 Cooke
5,979,410 A * 11/1999 Grieshaber ..... 123/467
6,062,531 A * 5/2000 Rapp et al. ..... 251/50
6,067,955 A * 5/2000 Boecking ..... 123/299

FOREIGN PATENT DOCUMENTS

| | | | |
|---|---|---|---|
| DE | 198 27 267 A1 | | 12/1999 |
| DE | 10015268 | * | 3/2000 |
| DE | 100 30 119 A1 | | 12/2000 |
| DE | 199 36 668 A1 | | 2/2001 |
| DE | 100 15 268 A1 | | 10/2001 |
| EP | 0 333 096 | | 3/1989 |
| EP | 0 333 097 | | 3/1989 |
| EP | 0 427 266 A1 | | 11/1990 |
| GB | 2 340 610 | | 8/1998 |
| GB | 2 335 000 | | 1/1999 |
| WO | WO 00/50761 | | 8/2000 |

* cited by examiner

*Primary Examiner*—Dinh Q. Nguyen

(74) *Attorney, Agent, or Firm*—Baker Botts L.L.P.

(57) ABSTRACT

A control module (1) for an injector of an accumulator injection system is used to control and guide a valve body (8). The control module comprises a high pressure supply line (2) for supplying fuel, and a guiding device (3) for guiding the valve body (8). A control room (4), an inlet throttle (5) and an outlet throttle (6) are also provided. The inlet throttle (5) connects the high pressure supply line (2) to the control chamber (4) and the outlet throttle (6) connects the control chamber (4) to a control valve (15). A control piston (7) is arranged in the control chamber (4), the end of the control piston opposite the control chamber (4) being connected to a high pressure region (9) on the valve body (8).

22 Claims, 3 Drawing Sheets

FIG 2
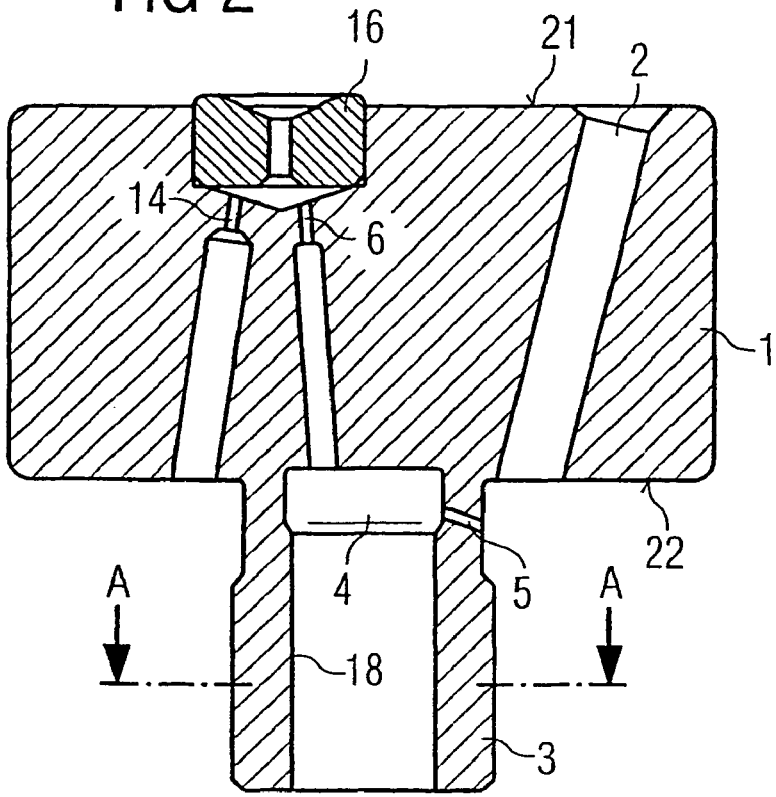
FIG 3 SECTION A-A
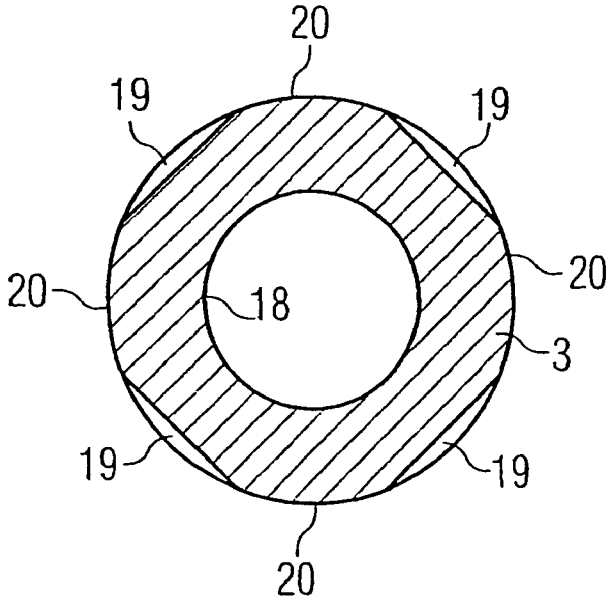

CONTROL MODULE FOR AN INJECTOR OF AN ACCUMULATOR INJECTION SYSTEM

CROSS REFERENCE TO RELATED APPLICATION

This application is a continuation of copending International Application No. PCT/DE02/02383 filed Jul. 1, 2002 which designates the United States, and claims priority to German application DE 101 31 953.3 filed Jul. 2, 2001.

TECHNICAL FIELD

The present invention relates to a control module for an injector of an accumulator injection system for the control and guidance of an injector valve body.

BACKGROUND OF THE INVENTION

Injectors for accumulator injection systems are known in various embodiments. A known injector of this type is illustrated by way of example in FIG. 4. Here, fuel is delivered into the surrounding region of the nozzle needle 36 via a high-pressure feed line 30. The nozzle needle 36 is in contact with a control piston 31 which is arranged with one end in a control space 32. The pressure in the control space 32 can be controlled in a known way via a control valve 33, so that the control space 32 can be connected to a tank T. That side of the control piston 31 which is opposite the control space 32 is in contact with a low-pressure space 34 which is connected to the tank T via a low-pressure outflow 35. As a result, the nozzle needle 36 can lift off from its seat in a known way and injection can take place.

In the injector concept shown in FIG. 4, however, a permanent leakage occurs in the nozzle needle guide 37 and in the guide 38 of the control piston 31, since the spaces acted upon by high pressure are connected to the low-pressure space 34 via sealing gaps. A fuel quantity therefore flows from the high-pressure region to the low-pressure space 34 via the two guides 37 and 38. However, this permanent leakage causes an appreciable loss of efficiency.

SUMMARY OF THE INVENTION

The object of the present invention is, therefore, along with a simple construction and simple cost-effective production capability, to provide a control module free of permanent leakage or an injector free of permanent leakage for accumulator injection systems.

This object can be achieved by means of a control module for an injector of an accumulator injection system for the control and guidance of a valve body, comprising a high-pressure inflow for the delivery of fuel, a guide device for guiding the valve body, a control space, an inflow throttle which makes a connection between the high-pressure inflow and the control space, an outflow throttle which makes a connection between the control space and a control valve, and a control piston which is arranged in the control space and which is connected indirectly or directly to the valve body and is connected at its end opposite the control space to a high-pressure region on the valve body.

The object can also be achieved by a control module for an injector of an accumulator injection system for the control and guidance of a valve body, comprising a high-pressure inflow for the delivery of fuel, a guide device for guiding the valve body, a one-part springless control space, a control piston which is arranged in the control space and which is connected indirectly or directly to the valve body and is connected at its end opposite the control space to a high-pressure region on the valve body, an inflow throttle which makes a connection between the high-pressure inflow and the control space, an outflow throttle which makes a connection between the control space and a control valve in any position of the control piston, and a nozzle spring for the return of the valve body, which surrounds the valve body and is arranged in the high-pressure region.

The object can furthermore be achieved by an injector for an accumulator injection system having a control module for the control and guidance of a valve body, comprising a high-pressure inflow for the delivery of fuel, a guide device for guiding the valve body, a control space, an inflow throttle which makes a connection between the high-pressure inflow and the control space, an outflow throttle which makes a connection between the control space and a control valve, and a control piston which is arranged in the control space and which is connected indirectly or directly to the valve body and is connected at its end opposite the control space to a high-pressure region on the valve body.

The control module may comprise a bypass throttle which makes a connection between the high-pressure inflow and the control valve. The control module may further comprise an annular duct which is arranged between the high-pressure inflow and the bypass throttle. The annular duct can be formed in the control module and/or in a nozzle housing. The guide device can be designed as a cylindrically annular extension. A connection region, which connects the high-pressure inflow to the high-pressure region on the valve body, can be provided on the outer circumference of the guide device or on the inner circumference of the nozzle housing. The connection region can be formed by a duct-like recess or by a plurality of recesses distributed on the outer circumference of the guide device and/or on the inner circumference of the nozzle housing. A nozzle spring for the return of the valve body can be supported, on the one hand, on the guide device and, on the other hand, on a spring plate arranged on the valve body.

Centering surfaces for centering the valve body can be provided on the guide device. The control piston and the valve body can be designed as a common one-piece component. The valve body can be designed as a nozzle needle.

The control module according to the invention for an injector makes it possible to have an injector free of permanent leakage, in that all the functional elements for the control and guidance of the valve body of the injector are integrated in one component. A minimum number of high-pressure sealing surfaces is therefore achieved. The high-pressure sealing surfaces are in this case designed solely as planes, so that there are no cylindrical guide surfaces which are necessary as high-pressure sealing surfaces in the prior art. An injector without the permanent leakage existing in the prior art can thereby be provided. The control module according to the invention has arranged in it in this case a high-pressure inflow, a guide device for guiding the valve body of the injector, a control space, an inflow throttle and an outflow throttle. Arranged in the control space is a control piston which is connected indirectly or directly to the valve body. The control piston is in this case connected with its end opposite the control space to a high-pressure region on the valve body. The control module according to the invention can thus also be constructed in a highly compact way, so that the overall dimensions of the injector can be further reduced, as compared with the prior art. Furthermore, the control module according to the invention also makes it possible, in particular, to dispense with the long high-pressure line, present in the prior art, which is conventionally led through the entire injector body and, in addition to its complicated production, may also lead to strength problems.

Preferably, the control module according to the invention further comprises a bypass throttle which makes a connection between the high-pressure inflow and the control valve of the injector.

By means of the bypass throttle, in particular, a shortened closing down of the injector can become possible.

In order to allow a capability of especially cost-effective production of the injector, an annular duct, which is arranged between the high-pressure inflow and the bypass throttle, is preferably provided. In this case, the annular duct may be formed either in the control module or in the nozzle housing of the injector. It is also possible for the annular duct to be formed by recesses both in the control module and in the nozzle housing.

According to a preferred embodiment of the present invention, the guide device of the control module is designed as a cylindrically annular extension. Particularly preferably, in this case, the control space is provided in the cylindrical extension and the valve body is guided in a middle recess formed in the cylindrical extension.

In order to provide an especially compact construction of the control module according to the invention, a connection region is provided either on the outer circumference of the guide device or on the inner circumference of the nozzle housing. The connection region connects the high-pressure inflow to the high-pressure region on the valve body of the injector. The connection region according to the invention can thus be produced in a simple way.

Particularly preferably, the connection region is formed by a duct-like recess or by a plurality of recesses distributed on the circumference of the guide device and/or of the nozzle housing. The connection region is in this case then obtained automatically, during the mounting of the nozzle housing onto the guide device, by the combination of two recesses formed at corresponding points. The geometric shape of the connection region can in this case be selected as desired, it being necessary to ensure merely that the recesses provide a sufficiently large cross section for a sufficient quantity of fuel.

According to a further preferred embodiment of the present invention, a nozzle spring for the return of the valve body is supported, on the one hand, on the guide device of the control module and, on the other hand, on a spring plate arranged on the valve body.

In order further to improve the accuracy of the injector during the injection of fuel, one or more centering surfaces are provided on the guide device, in order to center the valve body. A high accuracy of movement of the valve body can thereby be ensured.

The injection accuracy and the construction of the injector can be further improved in that, preferably, the control piston and the valve body are designed as a common component. Particularly preferably, the valve body is in this case designed as a nozzle needle.

The control module according to the invention for an injector is preferably used in accumulator injection systems, such as, for example, common-rail injectors for diesel engines. Since the control module according to the invention combines all the elements for controlling and guiding the nozzle needle in one component, the injector can be produced especially compactly and cost-effectively. Furthermore, the functional testing of this component is markedly simplified, and the control module has only a minimal number of high-pressure sealing surfaces. The required high-pressure strength of the injector can thereby be provided in a particularly cost-effective way.

Furthermore, by means of the control module according to the invention, a minimal volume of the control space can be achieved, thus affording appreciable advantages in terms of the switching dynamics of the injector and consequently also in terms of the smallest possible quantities of injected fuel which are capable of being achieved.

BRIEF DESCRIPTION OF THE DRAWINGS

The invention is described below with reference to a preferred exemplary embodiment, in conjunction with the drawing in which:

FIG. 2 shows an enlarged diagrammatic sectional view of the control module shown in FIG. 1;

FIG. 3 shows a sectional illustration along the line A—A of FIG. 2; and

DETAILED DESCRIPTION OF THE PREFERRED EMBODIMENTS

An exemplary embodiment according to the present invention is described below with reference to FIG. 1 to 3.

Figure 1:
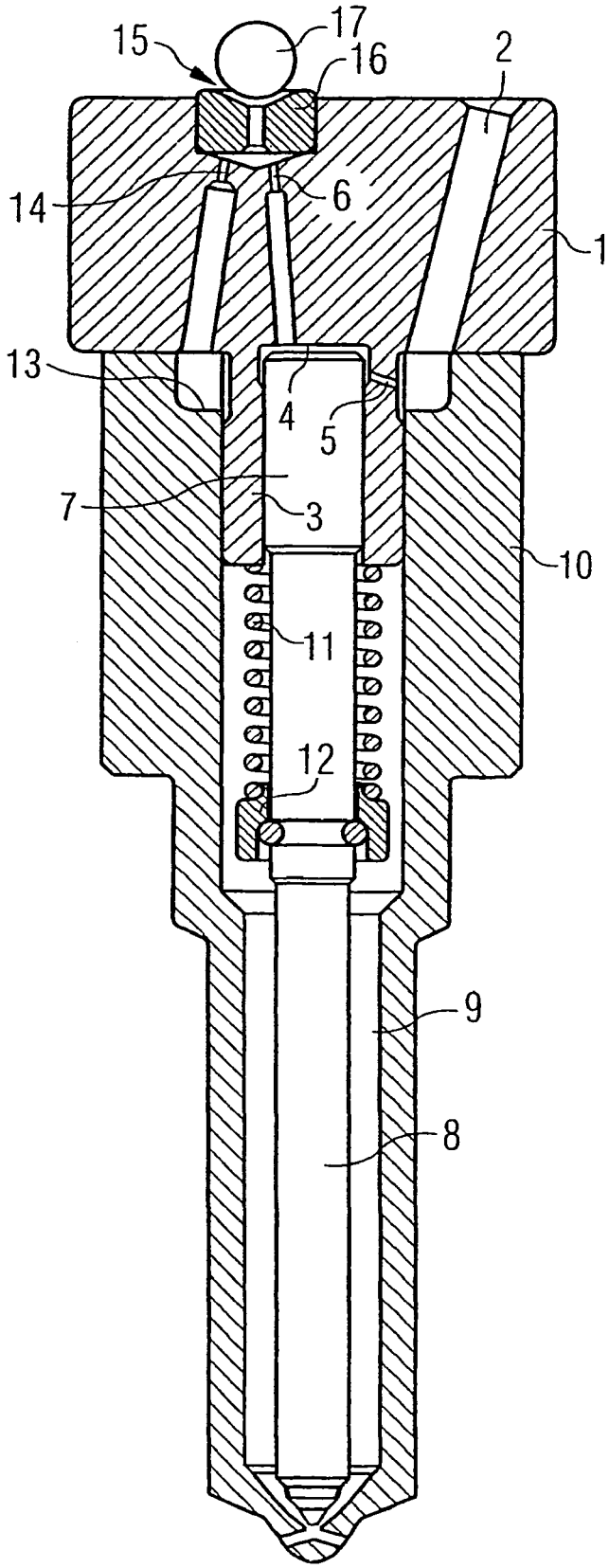
FIG. 1 shows a diagrammatic sectional illustration of an injector with a control module according to an exemplary embodiment of the present invention.
Figure 4:
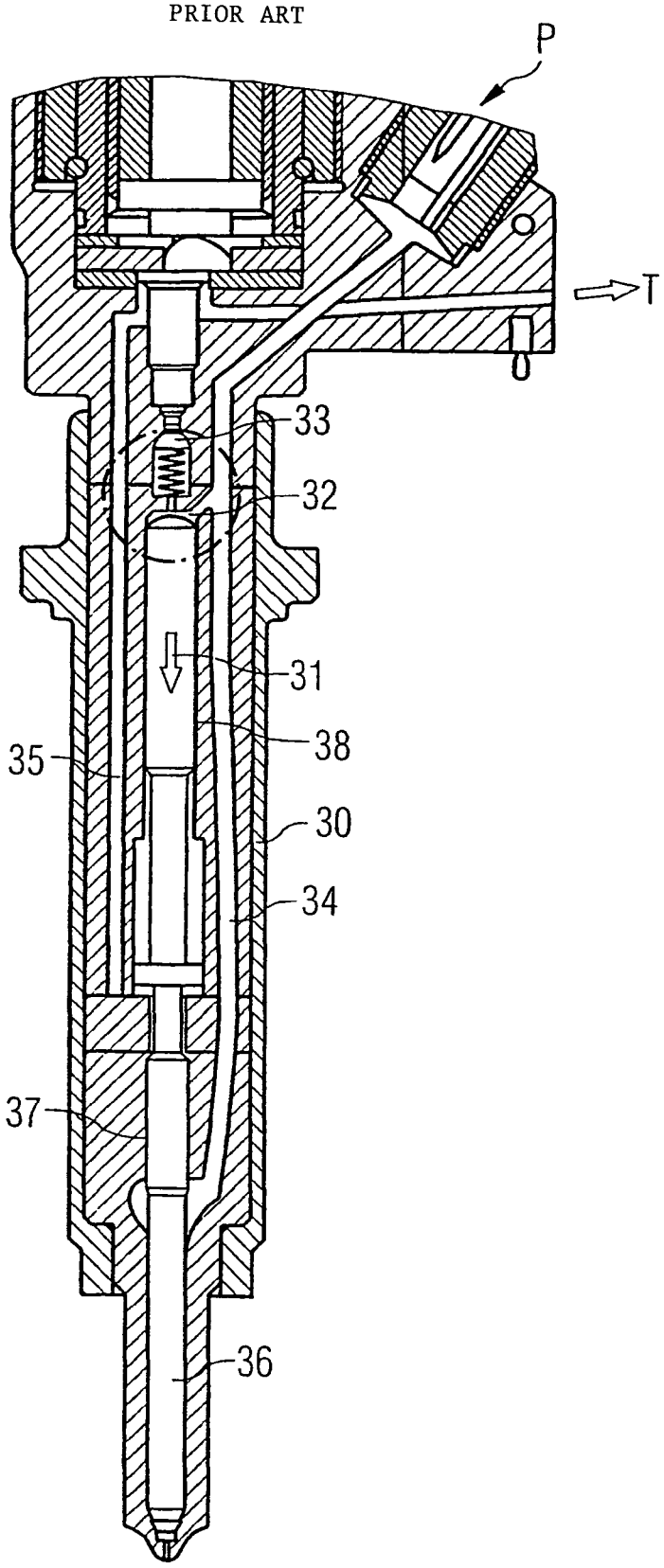
FIG 4 PRIOR ART
FIG. 4 shows an injector for an accumulator injection system according to the prior art.

As shown particularly in FIG. 1, the control module 1 according to the invention for an injector of an accumulator injection system has a highly compact construction. The control module 1 comprises a high-pressure inflow 2, in order to deliver fuel from a high-pressure pump to the injector. The control module 1 further comprises a guide device 3 for guiding a valve body 8 of the injector, a control space 4, an inflow throttle 5 and an outflow throttle 6. The inflow throttle 5 makes a connection between the high-pressure inflow 2 and the control space 4. The outflow throttle 6 connects the control space 4 to a control valve 15. The control valve 15 comprises a valve seat 16 and a valve ball 17 and is lifted off from the valve seat 16 by means of an actuator (not shown), such as, for example, a piezoelectric actuator, a magnetostrictive actuator or a solenoid, and in a known way makes a connection of the control space 4 to a low-pressure region.

Furthermore, a bypass throttle 14 in the control module 1 is provided, which connects the control valve 15 to the high-pressure inflow 2 via an annular duct 13 (cf. FIG. 1).

As is evident particularly from FIGS. 2 and 3, the guide device 3 is designed as a cylindrically annular extension. The needle guide 18 is formed in the inner central recess of the guide device 3 and the control space 4 is arranged at the end of the recess (cf. FIG. 2).

As shown in FIG. 1, the control piston 7 is produced in one piece with a nozzle needle 8, so that the guide 18 of the control piston 7 is at the same time also the guide for the needle. As shown in FIG. 3, four connection regions 19 and four centering surfaces 20 are formed on the outer circumference of the guide device 3. The connection regions 19 make a connection between the high-pressure inflow 2, more precisely the annular duct 13, and a high-pressure region 9 which is located at the nozzle needle 8. The connection regions 19 may, for example, be produced in a simple way by means of the grinding down of the cylindrical extension 3.

A nozzle spring 11 for the return of the nozzle needle 8 is supported, on the one hand, on the guide device 3 and, on the other hand, on a spring plate 12 which is provided in a known way on the nozzle needle 8 (cf. FIG. 1).

The functioning of the injector having the control module 1 according to the invention is described below. When an injection of fuel is to take place, the control valve 15 is actuated by means of an actuator, not illustrated, in such a way that the valve ball 17 lifts off from its valve seat 16. This gives rise, via the outflow throttle 6, to a connection between the control space 4 and a low-pressure region of the injector, so that the pressure in the control space 4 falls. The control piston 7 can thereby move into the control space 4 into the position illustrated in FIG. 1.

Thus, the nozzle needle 8 can lift off from its seat and an injection of fuel takes place. FIG. 1 shows the open position of the injector in which an injection of fuel takes place.

The fuel is thus delivered via the high-pressure inflow 2 and the annular duct 13, through the connection region 19 of the guide device 3, to the high-pressure region 9 at the nozzle needle 8.

When the injection is to be terminated, the control valve 15 is closed again by means of the actuator, so that fuel is delivered into the control space 4, on the one hand, via the inflow throttle 5 and, on the other hand, via the bypass throttle 14 and the outflow throttle 6. The pressure in the control space 4 thereby rises again, so that the control piston 7 is moved downward, so that the nozzle needle 8 closes the injection orifice again and injection is concluded. It may be noted that, during the filling of the control space 4 with fuel, the direction of flow in the outflow throttle 6 is reversed. The nozzle spring 11 in this case provides the closing force for the injector, since the pressure difference between the control space 4 and the high-pressure region 9 on the nozzle needle 8 is only relatively small.

Thus, by the control module 1 being designed according to the invention, an injector free of permanent leakage can be provided, since the high-pressure sealing surfaces 21 and 22 (cf. FIG. 2) present on the control module 1 are designed solely as planes which can be sealed off in a relatively simple way. Thus, according to the invention, sealing off in the region of the control piston or of the needle guide is no longer necessary, so that no leakage occurs when the injector is in the nonactuated state. Since, according to the invention, all the elements for the control and guidance of the nozzle needle are arranged in one component, furthermore, an injector which is particularly compact and can be produced particularly cost-effectively can also be provided.

Moreover, by the injector being designed according to the invention, a minimal volume can be achieved in the control space 4, thus leading to improved switching dynamics. Furthermore, as a result, even the smallest possible quantities of fuel can be injected with great accuracy. Thus, by means of the present invention, an injector free of permanent leakage can be provided for the first time, the consequence of this being that the efficiency of the injector is markedly improved, as compared with the prior art.

The present invention thus relates to a control module 1 for an injector of an accumulator injection system for the control and guidance of a valve body 8. The control module comprises a high-pressure inflow 2 for the delivery of fuel and a guide device 3 for guiding the valve body 8. Further, a control space 4, an inflow throttle 5 and an outflow throttle 6 are provided. The inflow throttle 5 connects the high-pressure inflow 2 to the control space 4 and the outflow throttle 6 connects the control space 4 to a control valve 15. Arranged in the control space 4 is a control piston 7 which is connected at its end opposite the control space 4 to a high-pressure region 9 at the valve body 8.

The foregoing description of the exemplary embodiment according to the present invention serves merely for illustrative purposes and not for the purpose of restricting the invention. Various changes and modifications are possible within the framework of the invention, without departing from the scope of the invention and of its equivalents.

We claim:

1. A control module for an injector of an accumulator injection system for the control and guidance of a valve body, comprising:

a high-pressure inflow for the delivery of fuel;

a guide device for guiding the valve body;

a control space;

an inflow throttle connecting the high-pressure inflow and the control space;

an outflow throttle connecting the control space and a control valve; and a control piston arranged in the control space and connected to the valve body and further connected at an end opposite the control space to a high-pressure region of the valve body.

2. The control module of claim 1, further comprising a bypass throttle connecting the high-pressure inflow and the control valve.

3. The control module of claim 2, further comprising an annular duct arranged between the high-pressure inflow and the bypass throttle.

4. The control module of claim 3, further comprising the annular duct formed in the control module.

5. The control module as claimed in claim 1, wherein the guide device is designed as a cylindrically annular extension.

6. The control module of claim 5 further comprising a connection region connecting the high-pressure inflow to the high-pressure region on the valve body provided on the outer circumference of the guide device.

7. The control module of claim 6 further comprising the connection region formed by at least one duct-like recess on the outer circumference of the guide device.

8. The control module of claim 1 further comprising a nozzle spring for the return of the valve body supported at a first end on the guide device and as a second end on a spring plate arranged on the valve body.

9. The control module as claimed in claim 1, wherein centering surfaces for centering the valve body are provided on the guide device.

10. The control module as claimed in claim 1, wherein the control piston and the valve body are designed as a common one-piece component.

11. The control module as claimed in claim 1, wherein the valve body is designed as a nozzle needle.

12. An injector for an accumulator injection system having a control module for the control and guidance of a valve body, comprising:

a high-pressure inflow for the delivery of fuel;

a guide device for guiding the valve body;

a control space;

an inflow throttle connecting the high-pressure inflow and the control space;

an outflow throttle connecting the control space and a control valve;

a control piston arranged in the control space and connected to the valve body and further connected at an end opposite the control space to a high-pressure region on the valve body; and a bypass throttle connecting the high-pressure inflow and the control valve.

13. A control module for an injector of an accumulator injection system for the control and guidance of a valve body, comprising a high-pressure inflow for the delivery of fuel;

a guide device for guiding the valve body;

a one-part springless control space;

a control piston which is arranged in the control space and which is connected indirectly or directly to the valve body and is connected at its end opposite the control space to a high-pressure region on the valve body;

an inflow throttle which makes a connection between the high-pressure inflow and the control space;

an outflow throttle which makes a connection between the control space and a control valve in any position of the control piston; and a nozzle spring for the return of the valve body, which surrounds the valve body and is arranged in the high-pressure region; and a bypass throttle connecting the high-pressure inflow and the control valve.

14. The control module of claim 13, further comprising an annular duct arranged between the high-pressure inflow and the bypass throttle.

15. The control module of claim 14 further comprising the annular duct formed in a nozzle housing.

16. The control module as claimed in claim 13, wherein the guide device is designed as a cylindrically annular extension.

17. The control module of claim 16 further comprising a connection region connecting the high-pressure inflow to the high-pressure region on the valve body provided on the inner circumference of the nozzle housing.

18. The control module of claim 17 further comprising the connection region formed by at least one duct-like recess on the inner circumference of the nozzle housing.

19. The control module of claim 13 further comprising the nozzle spring for the return of the valve body supported at a first end on the guide device and as a second end on a spring plate arranged on the valve body.

20. The control module as claimed in claim 13, wherein centering surfaces for centering the valve body are provided on the guide device.

21. The control module as claimed in claim 13, wherein the control piston and the valve body are designed as a common one-piece component.

22. The control module as claimed in claim 13, wherein the valve body is designed as a nozzle needle.

* * * * *